US005487865A

United States Patent [19]

Hampton et al.

[11] Patent Number: 5,487,865

[45] **Date of Patent: * Jan. 30, 1996**

[54] METHOD OF MAKING COMPLEX SHAPED METAL BODIES

[75] Inventors: Leslie E. Hampton, Corning, N.Y.; David S. Weiss, Corning, N.Y.

[73] Assignee: Corning Incorporated, Corning, N.Y.

[ * ] Notice: The portion of the term of this patent subsequent to Apr. 8, 2013, has been disclaimed.

[21] Appl. No.: 279,533

[22] Filed: Sep. 2, 1994

Related U.S. Application Data

[62] Division of Ser. No. 45,364, Apr. 8, 1993, abandoned.

[51] Int. Cl.[6] ..... B22F 3/10; B22F 5/10

[52] U.S. Cl. ..... 419/5; 419/30; 419/38

[58] Field of Search ..... 419/5, 30, 38

[56] References Cited

U.S. PATENT DOCUMENTS

| | | | |
|---|---|---|---|
| 3,137,602 | 6/1964 | Lincoln | 156/89 |
| 3,188,732 | 6/1965 | Feduska | 228/181 |
| 3,713,787 | 1/1973 | Kuniyasu et al. | 29/182.2 |
| 3,929,419 | 12/1975 | Chapman | 60/299 |
| 3,929,420 | 12/1975 | Woor | 60/299 |
| 4,125,380 | 11/1978 | Negola | 422/180 |
| 4,154,568 | 5/1979 | Kendall et al. | 422/171 |
| 4,268,482 | 5/1981 | Arashi et al. | 422/180 |
| 4,294,806 | 10/1981 | Abe et al. | 422/180 |
| 4,386,947 | 6/1983 | Mizuno et al. | 422/180 |
| 4,533,584 | 8/1985 | Takeuchi et al. | 422/180 |
| 4,582,677 | 4/1986 | Sugino et al. | 419/2 |
| 4,672,809 | 2/1987 | Cornelison et al. | 417/180 |
| 4,676,843 | 6/1987 | Nazmy | 228/193 |
| 4,722,824 | 2/1988 | Wiech, Jr. | 419/6 |
| 4,758,272 | 7/1988 | Pierotti et al. | 75/246 |
| 4,871,621 | 10/1989 | Bagley et al. | 428/549 |
| 4,969,593 | 11/1990 | Kennedy et al. | 228/193 |
| 4,992,233 | 2/1991 | Swaroop et al. | 419/2 |
| 5,051,232 | 9/1991 | Summers | 419/27 |
| 5,062,911 | 11/1991 | Hampton et al. | 156/89 |
| 5,064,608 | 11/1991 | Suzuki et al. | 419/8 |
| 5,105,539 | 4/1992 | Maus et al. | 29/890 |
| 5,211,918 | 5/1993 | Harte | 422/171 |
| 5,254,840 | 10/1993 | Thompson | 219/544 |
| 5,393,586 | 2/1995 | Lipp | 428/116 |
| 5,409,660 | 4/1995 | Alpha et al. | 419/5 |

FOREIGN PATENT DOCUMENTS

0488716A1 11/1991 European Pat. Off. .

OTHER PUBLICATIONS

Greenwood, H. W., "Joining Porous Metal Parts To Other Metals," *Metallurgia*, 44, No. 263, pp. 141–143, (1951).

*Primary Examiner*—Donald P. Walsh
*Assistant Examiner*—Scott T. Bluni
*Attorney, Agent, or Firm*—Rita Quatrini

[57] ABSTRACT

A complex body and method of making same which includes forming an assembly of green bodies, each body having an inlet end and an outlet end and having a multiplicity of cells extending from inlet to outlet end, and sintering the assembly at a temperature and time sufficient to cause interdiffusion of the metals between the bodies to join them and form the complex body.

8 Claims, 4 Drawing Sheets

METHOD OF MAKING COMPLEX SHAPED METAL BODIES

This is a divisional application of application Ser. No. 08/045,364, filed on Apr. 8, 1993, now abandoned.

This invention relates to a method of making complex shaped multicellular metal bodies by sintering together green bodies which are in contact with each other. The bodies can be positioned end to end with their cells either aligned or rotated with respect to one another to provide a convoluted flow path for gases passing therethrough. Or the bodies can be positioned so that they are joined along at least part of their sides with their cells either parallel or non-parallel to one another to provide passage for flow of gases respectively either unidirectionally or multidirectionally therethrough.

BACKGROUND OF THE INVENTION

Honeycombs are extruded into fairly simple overall geometries (e.g., cylinders). Some application requirements may demand more complex shapes than can be achieved by extrusion while still retaining the extruded cellular structure. Bonding together of extruded components after sintering can cause distortion of the thin wall cells by heating during joining processes such as brazing and welding. Bonding of components during sintering through the use of a paste or slurry applied to cellular surfaces can smear cell terminations and block free flow through joined cells. Paste or slurry is good for joining solid components, like electrodes, to cellular parts, but is less useful for joining honeycombs together.

Metal honeycombs are used for automotive exhaust pollution reduction. The effective surface area of the metal honeycomb, and therefore, its catalytic activity can be increased by producing a tortuous flow path for the exhaust gas which passes through the honeycomb. Various methods are used to increase flow path length. One such method is a "herringbone" pattern impressed into the surface of metal sheets used for foil honeycombs.

It would be advantageous to have a method of joining of cellular parts during sintering which does not require the use of a joining substance. Since extruded metal honeycombs are now used in catalytic applications, it would be advantageous to have a method of increasing the flow path length and varying flow path configurations of such honeycombs.

The present invention provides a method for achieving the above.

SUMMARY OF THE INVENTION

In accordance with one aspect of the invention, there is provided a complex body formed from two or more component bodies, each component body having an inlet end and an outlet end and having a multiplicity of cells extending from inlet to outlet end, the component bodies being joined by interdiffusion of metals between adjacent bodies.

In accordance with one aspect of the invention, there is provided a method of making a complex shaped body, which includes providing a plurality of green metal bodies, each body having an inlet end and an outlet end and having a multiplicity of cells extending from inlet to outlet end, forming an assembly of the green bodies, and sintering the assembly at a temperature and time sufficient to cause interdiffusion of metals between the bodies to join them and form the complex body.

DETAILED DESCRIPTION OF THE INVENTION

This invention relates to a method of making complex metal bodies from green bodies without the use of any kind of joining material as such brazing, soldering, etc. The joining is promoted by interdiffusion of metals between the component green bodies during sintering and there is no microstructural disruption as with welding or brazing.

The invention is applicable to metal bodies having inlet and outlet ends and a multiplicity of cells, e.g., open ended cells extending from inlet to outlet ends. The invention is especially applicable to honeycombs. Honeycombs are multicellular bodies with walls or webs between the cells.

Some examples of honeycombs, although it is to be understood that the invention is not limited to these, are those having about 94 cells/cm$^2$ (about 600 cells/in$^2$), about 62 cells/cm$^2$ (about 400 cells/in$^2$), or about 47 cells/cm$^2$ (about 300 cells/in$^2$), those having about 31 cells/cm$^2$ (about 200 cells/in$^2$), or those having about 15 cells/cm$^2$ (about 100 cells/in$^2$). Typical wall thicknesses in catalytic converter applications, for example, are about 5 mils (about 0.13 mm) for 400 cells/in$^2$ (62 cells/cm$^2$) honeycombs. Web thicknesses range typically from about 4 to about 25 mils (about 0.1 to about 0.6 mm). The external size and shape of the body is controlled by the application.

The joining is promoted by insuring that the mating surfaces are flat, co-parallel, and free of dirt and other contamination. Joining of honeycombs by this technique allows retention of body alignment and cells openings which were established in the green body. This is not the case for other joining techniques which disrupt the fine cell geometry of extruded metal honeycombs.

The bodies can be assembled in any convenient shape.

Figure 1:
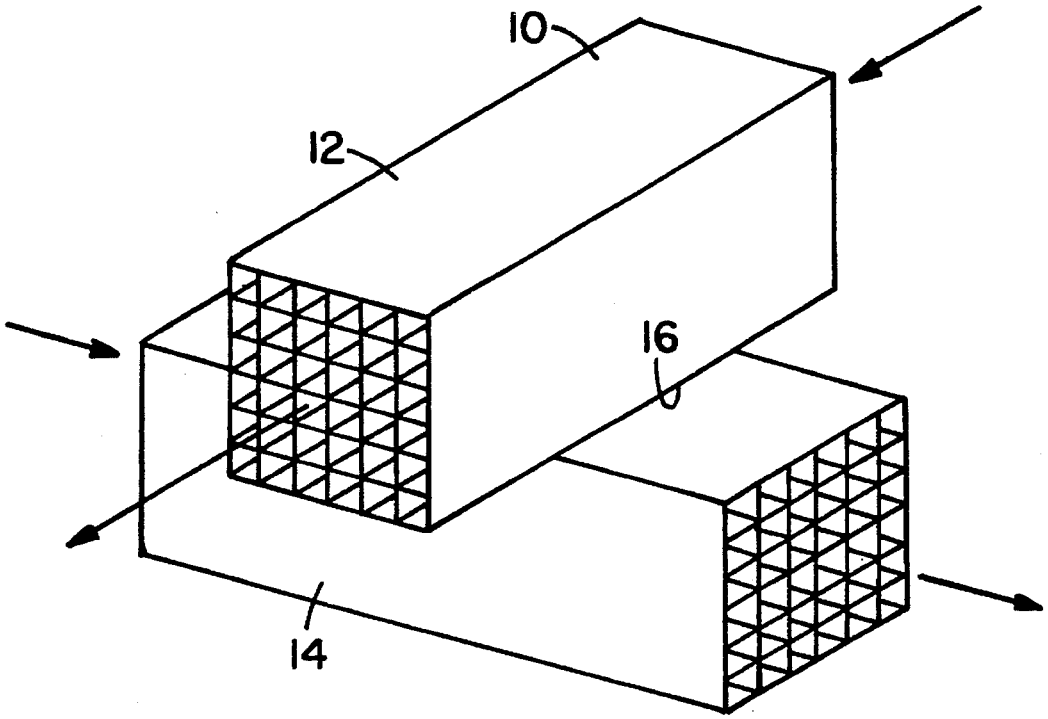
FIG. 1 is a schematic diagram showing a complex body in which component honeycomb bodies are arranged one atop the other with their respective cells running non-parallel.
Figure 2:
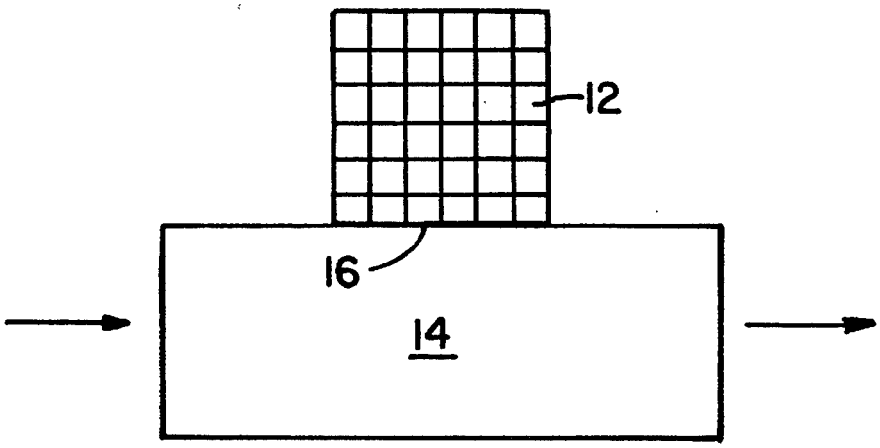
FIG. 2 is a schematic diagram showing an axial view of one component honeycomb body and a transverse view of another in a complex body, and the point of jointure of the component bodies.
Figure 3:
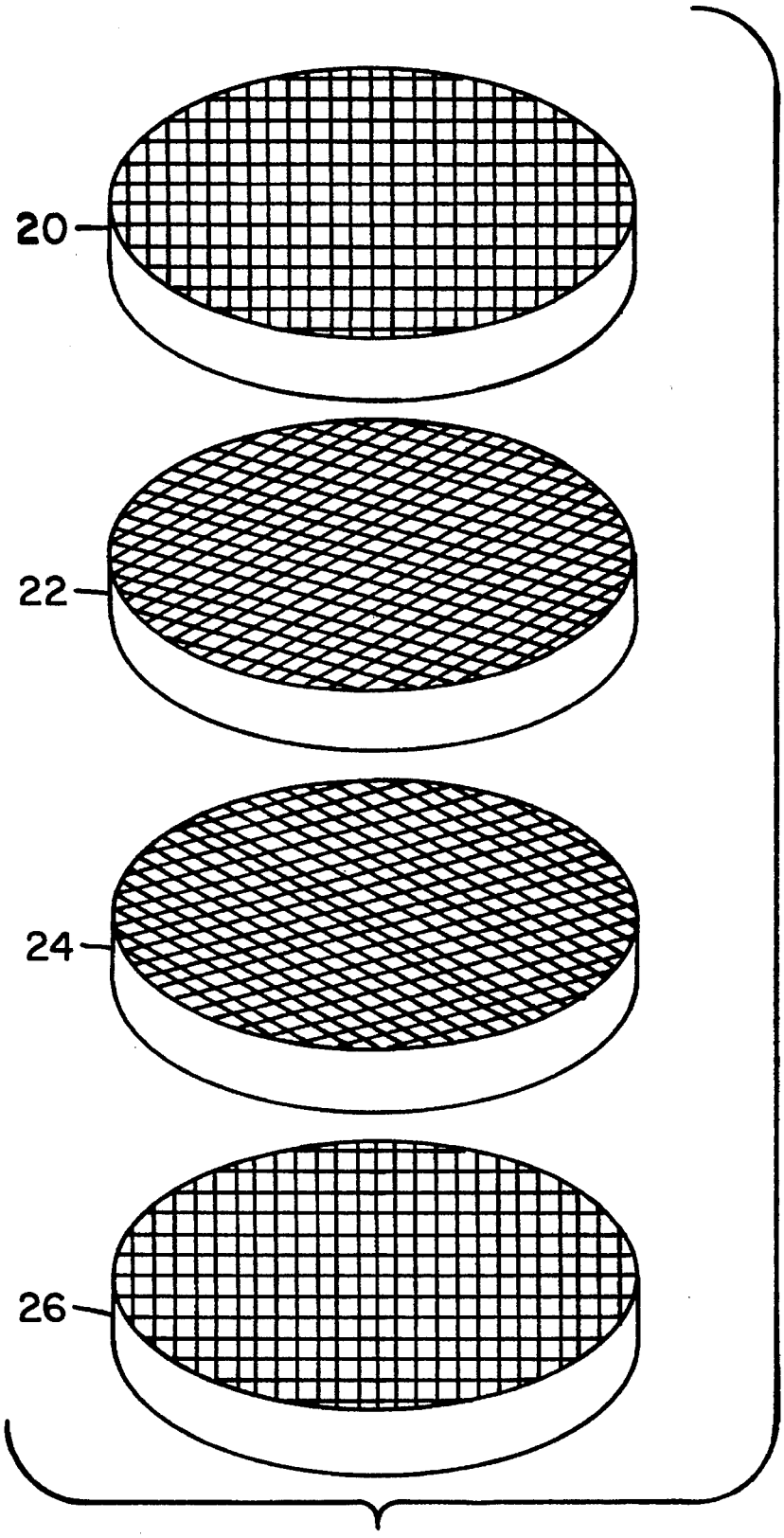
FIG. 3 is a schematic representation of four honeycombs stacked end to end with the cells of each honeycomb rotated with respect to its neighboring honeycomb(s).

For example, the honeycombs can be joined at least part of their outer configural surfaces, with their cells running either parallel or non-parallel with respect to one another. By outer configural surfaces is meant the outer surfaces surrounding the cells of the body. For example, the bodies are placed one on the other and the pressure generated by the weight of the top body or bodies acts over the surface or surfaces joining the bodies, thereby sintering together the mating surfaces. FIG. 1 shows such an arrangement with the cells running non-parallel. In FIG. 1 is shown a complex shaped body (10) made of two honeycombs (12) and (14) one atop the other. FIG. 2 is a schematic diagram showing an axial view of component body (12) and a transverse view of component body (14) and their point of jointure (16) of the complex body of FIG. 1. Such a complex body can be used in applications in which cross flow is utilized. The bodies can be positioned side by side so that all their cells are parallel. In such a case, a holding or clamping device would be employed to insure that the surfaces remain in contact during the sintering. The geometries of the individual component bodies, that is, size, shape and density and number of cells can vary depending on the application and the cross flow pattern that is desired. It is contemplated that any number of component honeycombs can make up the complex body, and that they can be arranged in any combination of parallel and non-parallel orientation and these can vary as far as overall size and shape of the bodies, and as far as number, size, and shape of cells. The honeycombs can be joined end to end (at their axial ends or open cellular faces) so that the orientation of the cells of each honeycomb is rotated with respect to the neighboring honeycomb as shown in FIG. 3. FIG. 3 is a schematic representation of four honeycombs, (20), (22), (24), and (26), stacked end to end with the cells of each honeycomb rotated with respect to the neighboring honeycomb. The four honeycombs are assembled to make a single complex body with a convoluted flow path. Such a body can be used in applications in which increased exposure of flowing gas to surfaces is needed as in a catalytic converter.

In the joining of honeycombs, other parts of essentially the same metal composition but which are not to be joined as part of the complex body, are typically used to support the assembly during sintering. In such cases, a release agent is placed between the complex body assembly and the other non-assembly parts to avoid sintering of these other parts to the complex body. Some release agents that are suited to the practice of the present invention, although the invention is not limited to these, are boron nitride, and alumina.

It has been found that a mixture of alumina and a vehicle which readily evaporates after application of the alumina to the parts, is especially suited to the practice of the present invention.

The alumina must be high purity. Advantageously, it has little or no Si contamination, e.g., no greater than about 0.02 wt. % $SiO_2$. The alumina should be fine alumina. By fine alumina is meant a median particle diameter of no greater than about 5 micrometers. The fine particle size of the release agent alumina powder provides enough surface area to evenly distribute the weight of one part against another. For example, in honeycombs in which one part is atop the other, the weight of the upper part is evenly distributed over the web surfaces of the lower part. When at least one of the parts having a contacting surface is a honeycomb structure, the median particle diameter is no greater than about 3 micrometers. As a general rule for most parts, and especially when one of the parts having a contacting surface is a honeycomb with wall thicknesses of about 0.10 to about 0.20 millimeters, the median particle diameter of the alumina is advantageously no greater than about 1.5 micrometers, and more advantageously no greater than about 0.5 micrometers. A preferred alumina is one having a particle size distribution of about 90% of the particles being $\leqq 1$ μm, about 50%$\leqq$0.44 μm, and about 10%$\leqq$0.19 μm, as determined by sedigraph analysis. One preferred source of such alumina is supplied by Alcoa under the name of A-16.

The vehicle is a liquid medium for dispersing the alumina for uniform application of the alumina to the desired surfaces of the bodies. The vehicle must be able to disperse the alumina without dissolving it or changing its particulate nature. The vehicle must be essentially non-reactive with the alumina and non-reactive with the green metal body. The vehicle must have a vaporization temperature that will allow it to function as a liquid medium for the alumina at operating temperatures but which will allow it to readily and cleanly evaporate after application of the alumina to the parts. Accordingly, the vapor pressure of the medium at atmospheric pressure is less than about 100° C., and advantageously about 50° C. to less than about 100° C. Some vehicles that can be used in the practice of the present invention, although it is to be understood that the invention is not limited to these, are those of the alkanes, alkenes, alkynes, alcohols, amines, aromatics, esters, ketones, halogenated compounds, and combinations thereof, whose vapor pressures fall within the above described temperatures, and which are non-reactive with alumina and non-reactive with the body. Also included are derivatives of the above classes of vehicles that fulfill these requirements. Choice of vehicle depends on environmental, safety, economic, and availability factors. Alcohols are advantageous. Some examples of alcohols are methyl, ethyl, propyl, isopropyl, secondary butyl, and tertiary butyl alcohols, and combinations thereof, with isopropyl alcohol being the preferred vehicle. The relative amounts of alumina and vehicle are chosen to result in the best handleability for the specific vehicle. The alumina/vehicle ratio should not be so high as to make the mixture too thick to apply to the body surfaces involved, or so low that the mixture is too thin to deliver the proper amount of alumina release agent to the body surfaces involved.

In accordance with a preferred embodiment, the vehicle is isopropyl alcohol. It is advantageous that the weight ratio of alumina to isopropyl alcohol be greater than about 1:7.5 and less than about 5:2. Ratios 1:1.75 or less are too thin, the alumina is not kept in suspension to form a satisfactory coating, and the isopropyl alcohol evaporates readily before application of the mixture. Ratios of about 5:2 or greater are too thick to apply. The ratio is advantageously about 1:6 to about 5:3 and more advantageously about 1:5 to about 5:4 because the consistency of the mixture is generally good and the separation after sintering is good. Most advantageously the ratio is 1:5 because it results in the least residue after sintering.

The bodies are assembled in the green state and then sintered together. The term "green" is used in the art and in this application to refer to the state of a formed body made of sinterable powder or particulate material that has not yet been fired to the sintered state. The green body can be dried to remove fugitive phases such as binder phases, vehicle phases, etc. The starting individual green bodies that are to form the complex body are made typically by extruding a plasticized mixture of metal and/or metal alloy powders, binders, vehicle etc. Such extrusion processes are known in the art.

It is contemplated that any sinterable metal or metal composition that is formed into multicellular bodies can be used. Most typically the metal is iron group metal and aluminum, with the preferred iron group metal being iron. Especially preferred is Fe, Al, and Cr. For example, Fe5-20Al5-40Cr, and Fe7-10Al10-20Cr powders with other possible additions are especially suited. Some typical compositions of metal powders are disclosed in U.S. Pat. Nos. 4,992,233, 4,758,272, and European patent application publication no. 488716A1 which are herein incorporated by reference as filed. U.S. Pat. No. 4,992,233 relates to methods of producing porous sintered bodies made from metal powder compositions of Fe and Al with optional additions of Sn, Cu, and Cr. European patent application publication no. 488716A1 relates to porous sintered bodies having a composition consisting essentially of in percent by weight about 5 to about 40 chromium, about 2 to about 30 aluminum, 0 to about 5 of special metal, 0 to about 4 of rare earth oxide additive and the balance being iron group metal, and unavoidable impurities such as e.g., Mn or Mo, with the preferred iron group metal being iron. When rare earth oxide is present, the special metal is at least one of Y, lanthanides, Zr, Hf, Ti, Si, alkaline earth metal, B, Cu, and Sn. When no rare earth oxide is present, the special metal is at least one of Y, lanthanides, Zr, Hf, Ti, Si, and B, with optional additions of alkaline earths, Cu, and Sn.

In general the metal and/or metal alloy powders and optionally rare earth oxide powders are mixed in amounts to result in the body having the desired composition. The starting metal powders are iron, cobalt, nickel, chromium, aluminum metals, and special metal powders, if they are to be used. The metal can be supplied in either the unalloyed form or alloyed with one or more of the other metals, or partially unalloyed and partially alloyed. Most typically, however, the iron, when added as the balance, is in the elemental form. The chromium can be elemental or alloyed with aluminum or iron. Chromium-aluminum alloy is preferable. Typically, the aluminum is supplied alloyed with iron and/or chromium for stability. Some typical alloy powders that can be used in formulating the mix to yield a body having some typical compositions of the present invention are Fe—Cr—Al—(Y, lanthanide series elements, Zr, Hf, or Cu) alloy powder, Cr—Al—(Y, lanthanide series elements, Zr, Hf, or Cu) alloy powder, Fe—B, Fe—Si powder, etc.

The particle size of the starting powders depends on the end product that is to be produced. For example, if honeycombs are to be produced having (as sintered) about 62 cells/cm$^2$, (about 400 cells/in$^2$) and about 180 micrometer thick cell walls, the particle size is typically but not exclusively, about 44 micrometers in diameter or less. If honeycombs are to be produced having about 47 cells/in$^2$ (about 300 cells/in$^2$) and about 250 micrometer thick walls, the particle size is typically but not exclusively, about 53 micrometers in diameter or less. If honeycombs are to be produced having about 31 cells/cm$^2$ (about 200 cells/in$^2$), and about 300 micrometer thick walls, the particle size is typically but not exclusively, about 74 micrometers in diameter or less.

A relatively uniform admixture is formed of the above metal powders and optionally, rare earth oxides. This is done typically by dry blending to form a homogeneous blend.

The admixture is formed into a green body. This can be done by any method known in the art, e.g., pressing, injection molding, extruding, etc., with extrusion being preferred. Depending on the forming method, binders, forming aids, and vehicles can be added as necessary. For example, non-aqueous binders such as acrylic resins with polyvinyl alcohol or silicon resins can be used with diacetone as the vehicle. Paraffin and other waxes are used in injection molding with stearic acid or glycerin as a lubricant. One preferred method of making the green body is to combine an organic binder, e.g., methyl cellulose, polyvinyl alcohol, etc. and vehicle and optionally other aids, e.g., aids to prevent oxidation, to form a relatively homogeneous wet mixture. This is done typically by adding the binder and aid or aids (if used) to the admixture, and forming a dry blend. The vehicle is then added to form the wet mixture. One example of a binder/vehicle combination is methyl cellulose/water respectively. With this combination, it is preferred to add an organic acid such as oleic acid as an aid to prevent oxidation of the metal powders. One example of a binder/aid/vehicle combination is about 4 g methyl cellulose, about 1 g oleic acid and about 11 g to about 12 g water per about 100 g of the admixture composition. This mixture is formed into a green body by extruding. At this point, the body is usually dried, although this is not necessary. This is done typically by air drying.

The formed green bodies whether dried or not, are formed into an assembly by being put in contact with one another as described previously, and sintered to form a complex dense body. The sintering time and temperature are sufficient to cause interdiffusion of the metals between the green bodies. The sintering is done in a non-oxidizing atmosphere, preferably an atmosphere containing hydrogen, at a sufficient temperature for a sufficient time to bind the bodies to one another and form a densified complex body. The total porosity of the complex body is about 0% to about 50%. It is preferred that the complex body be essentially completely densified, that is for the purposes of the present invention, have a total porosity of no greater than about 2%. The preferred sintering atmosphere is hydrogen. A preferred sintering technique is to surround the green bodies with an enclosure in the vicinity of the bodies.

For bodies made of iron group metals, the preferred sintering temperatures are from about 1000° C. to about 1450° C. In general, if the sintering temperature is lower than about 1000° C., no sintering is achieved. Generally sintering conducted at temperatures higher than about 1450° C. caused deformation of the complex body or increases production cost, and is therefore, as a rule, undesirable.

The sintering time depends on factors such as temperature, size and number of the green bodies, design of the equipment, furnace atmosphere, etc. Also, the sintering temperature is determined so that any contained C, N, is present at a level of no greater than about 1% by weight each, and O is no greater than about 3% by weight. The sintering times are usually about 2 hours or longer.

Diffusion of the component metals between the adjacent bodies causes them to bond together during sintering to form the complex body.

The complex body can be used in high temperature applications in oxidizing atmospheres, such as for example, in carriers for catalysts for exhaust gas purification, etc., heaters, e.g., catalyzed heaters, or electrically heated catalysts, catalytic converters, etc.

The bonding of the present invention is distinguished from so called "sinter-joining" processes. In those processes, dense metal bodies, whether sintered or formed from a melt, have surfaces defined by grain boundaries. These grain boundaries form during the sintering or solidification of atoms and dislocations at the lowest energy level resulting from the processing conditions to which the metal was subjected. Once these grain boundaries are formed, energy must be added to the system to overcome the threshold energy barrier and arrive at a new lower energy, configuration. This process has to take place for stable grain bounded surfaces to reconfigure and join. The energy to activate stable grain boundaries can come from reheating to a temperature greater than the original sintering temperature and/or a variety of other techniques to enhance interaction between adjacent surfaces. In any case, joining of densified bodies by "direct sintering" requires an additional processing step and additional energy input. In this respect, it is simply a variation of other secondary methods of joining, such as brazing, welding, and soldering. The only apparent difference is than an additional joining phase (e.g., braze) is not used. The present invention relates to simultaneous consolidation and joining. The sintering processes (in broad terms, surface area reduction and compositional homogenization) that drive densification of the powder metal body according to the present invention also promote joining by interdiffusion of phases between adjacent green parts. The sintering and joining processes are contemporaneous. The resulting complex body has no discontinuity where separate greenware pieces were joined.

The unique processing characteristics of extruded metal bodies allows them to be joined prior to sintering without resulting microstructural discontinuity between adjacent joined areas. This provides uniform properties throughout the finished complex body. For example, because of the monolithic structure of the bonded complex body, electrical continuity is established relatively uniformly throughout the entire structure of the complex body. Because some metal honeycombs are used as preheaters, and are resistively heated in that application, electrical continuity through the body is critical. Also, thermal shock resistance is not degraded by discontinuities between joined pieces. The extrusion process allows the production of a wide range of cell geometries. The sinter welding process provides the means to further expand the range of honeycomb part geometry by joining together in a single fired body differently oriented pieces of honeycomb. Cell geometry and orientation of the pieces can be adjusted to produce desired gas flow paths, and therefore, time of gas exposure to catalysts on the honeycomb surfaces.

In accordance with a preferred embodiment, the resulting sintered complex body is heat-treated in an oxidizing atmosphere at a sufficient temperature, at any desired rate, for a sufficient time to form an oxide coating on the surfaces of the complex body. The coating is typically aluminum oxide. The oxide coating is present on all external surfaces including the open pore surfaces and on the configural surfaces of the body. The heat-treating temperature and time are sufficient to result in a relatively uniform and complete coating of the oxide. Some typical atmospheres are air, high humidity air, wet hydrogen, carbon dioxide, or mixtures of oxidizing and inert gases at various dew points. Most typically, the atmosphere is air. The preferred heat-treating temperatures are about 700° C. to about 1200° C., and more preferably about 1000° C. to about 1200° C. Heat-treating time depends on factors such as temperature, size of the body, design of the equipment, furnace atmosphere, etc. Typical heat-treating times can vary from one minute to several hours. The oxide coating enhances the oxidation resistance of the body and enables a catalyst to be more easily supported on the body. In compositions containing yttria, thet yttria slows the rate of the oxide coating or scale build-up and leads to a thinner adherent protective oxide coating which protects the metal surface during exposure to high temperatures and corrosive environments.

The complex body can be used in high temperature applications in oxidizing atmospheres, such as for example, in carriers for catalysts for exhaust gas purification, etc., heaters, e.g., catalyzed heaters, or electrically heated catalysts, catalytic converters, etc.

To more fully illustrate the invention, the following non-limiting examples are presented. All parts, portions, and percentages are on a weight basis unless otherwise stated.

Inventive Example 1

Extruded metal honeycombs of nominal composition Fe-12Al-10Cr and of the nominal cell geometry 400 cells/in$^2$ (about 62 cells/cm$^2$), with 0.007" (0.18 mm) wall thicknesses are made by extruding plasticized mixtures of the appropriate metal and/or metal alloy powders and drying. Four cellular blocks about 2.5" (about 6.35 cm) long× about 2.5" (about 6.35 cm) wide and about 0.6" (about 1.52 cm) thick are cut such that the axial orientation of the cells runs along the length of each block. The large faces of each block are sanded to create flat and parallel (relative to the opposite face of the piece) surfaces. The four blocks are stacked one atop the other such that the sanded faces are in contact with each other. The axial direction of each block is at right angles to the next piece (above or below) in the stack. The stacked blocks are carefully placed into the sintering furnace on a thin slice of honeycomb, with its axial direction oriented vertically. This thin piece or cookie is lightly coated with a release agent to prevent its sticking to the honeycomb which rests upon it. Alternately, the stack can be built upon the cookie in the furnace to prevent disruption of the stacked structure during moving and furnace loading. Once loaded in the furnace, the stack is surrounded by an enclosure of molybdenum foil of about 0.01" in thickness. The enclosure is made to fit relatively closely around the stack of parts. The purpose of the enclosure is to protect the honeycombs from contamination by furnace gas borne impurities during critical steps in the sintering process. The furnace is a cold-wall vacuum-atmosphere unit of standard design. After the furnace is completely loaded, the sintering schedule is begun. The sintering schedule runs from about room temperature to about 1350° C. with various ramps and holds such as according to the sintering schedule given below:

| °C. | Over time period (min.) | Hold |
|---|---|---|
| Room temperature-275 | 60 | |
| 275–455 | 60 | |
| 455 | | 60 |
| 455–700 | 60 | |
| 700 | | 30 |
| 700–1000 | 30 | |
| 1000–1350 | 35 | |
| 1350 | | 240 |
| 1350-room temperature | | |

After the furnace cools from sintering sufficiently, it is opened and the samples are removed. They are joined together where they rested upon each other during the sintering process. The resulting structure is a monolithic honeycomb body that can be used where cross flow through adjacent regions is desired. Such a body can be used as a heat exchanger.

Inventive Example 2

Convoluted Flow Structure

Figure 4A:
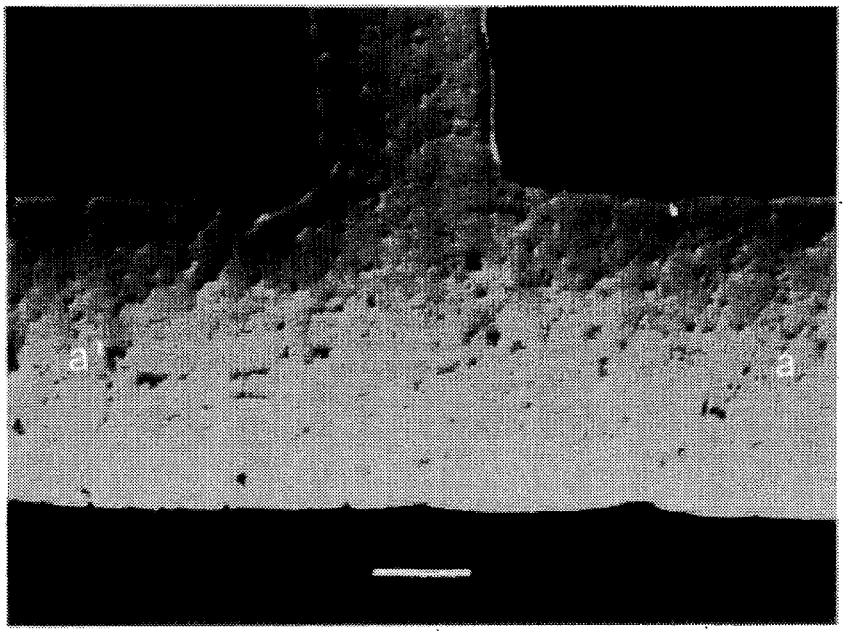
FIGS. 4*a* and 4*b* are light optical microscopic views showing the point of joining of two component honeycombs in a complex body, using Nomarski differential interference contrast in 4*a*, and polarized light in 4*b*.
Figure 4B:
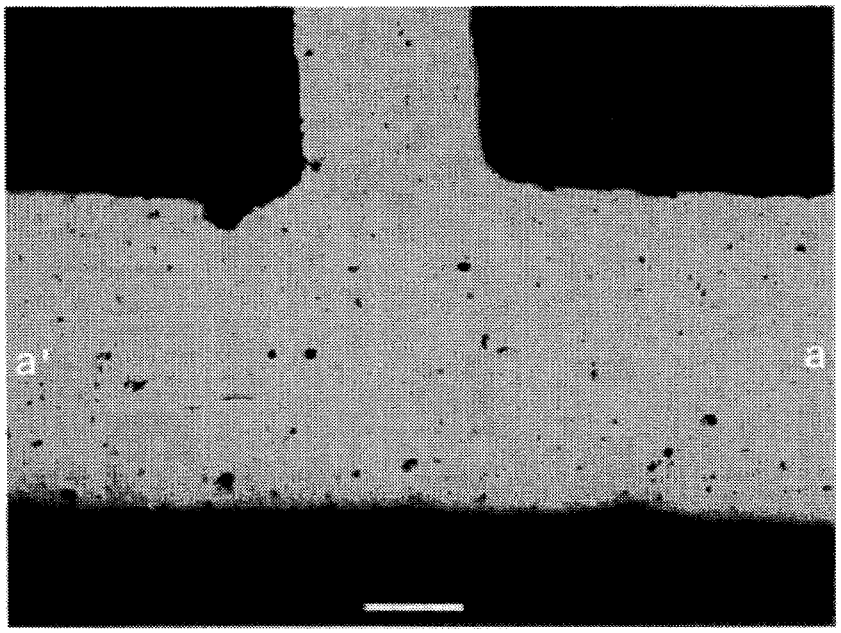
Figure 5B:
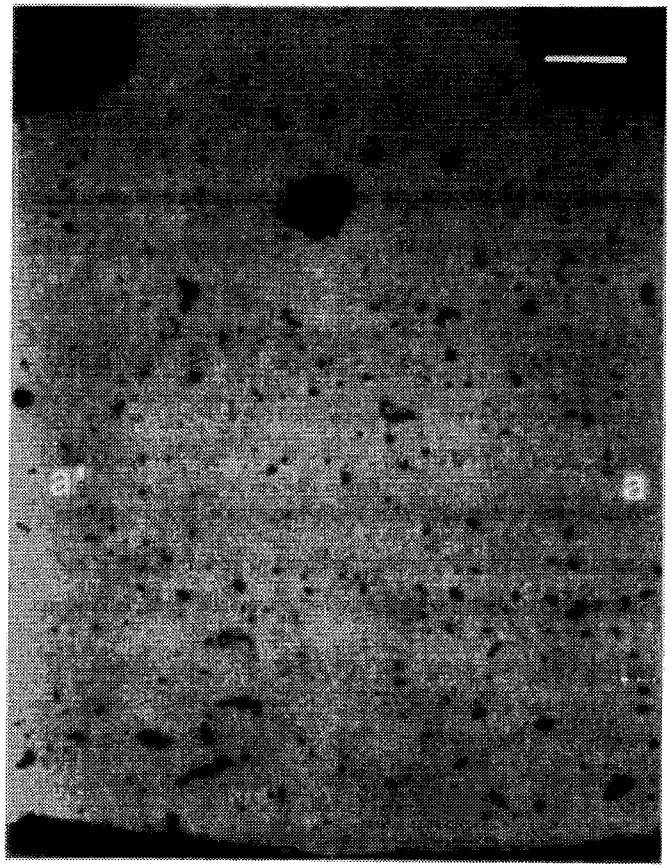
FIGS. 5*a* and 5*b* are light optical microscopic views showing another point of joining of two component honeycombs in the complex body under higher magnification than 4*a* and 4*b*, using Nomarski differential interference contrast in 5*a* and polarized light in 5*b*.
Figure 5A:
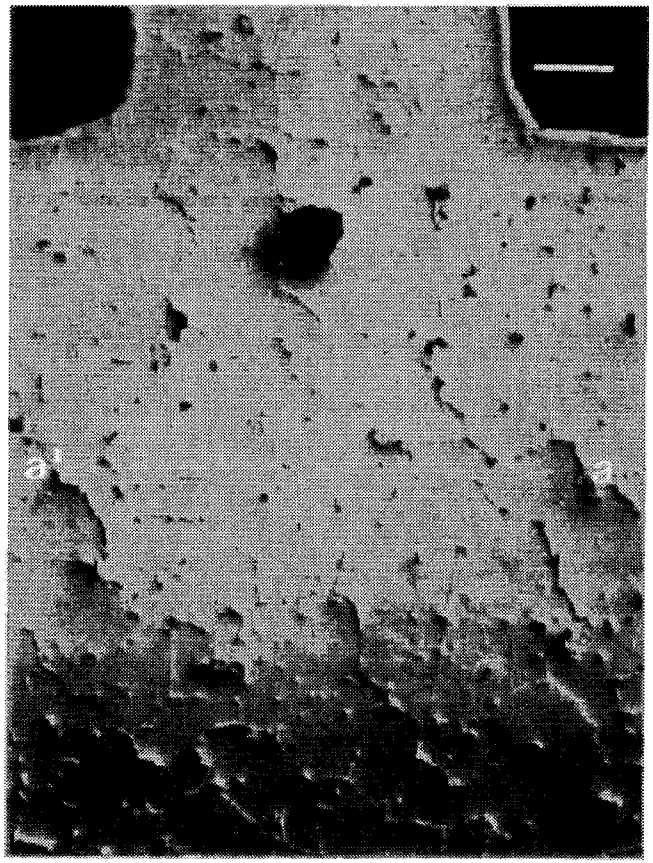

Extruded metal honeycombs of the nominal composition Fe-12Al-10Cr and of the nominal cell geometry 450 cells/in$^2$ (about 70 cells/cm$^2$) with about 0.005" (about 0.13 mm) are made as described in Example 1. Four parts, each approximately 3.5" (about 8.9 cm) diameter and about 0.6" (about 1.52 cm) thick is used. Each axial face of each piece is sanded to form flat and parallel (relative to the opposite face of the piece) surfaces. These pieces are placed one atop the other such that the cell channels of each piece are placed coaxially, and the orientation of the cell walls is rotated about 30° from the piece above and/or below. The stack of pieces is prepared and sintered in a manner similar to that described in Example 1. This results in a monolithic honeycomb structure with a tortuous flow path relative to a uniaxial honeycomb. Such a body can be used in applications in which turbulent flow of a medium through the cells is desired, for instance an electrically heated catalytic converter in which heat from the cells is to be passed into gas flowing through the cells. FIGS. 4*a*, 4*b*, 5*a* and 5*b* show magnified light optical microscopic views of part of a honeycomb structure comprised of two separate green honeycombs that are joined together during the sintering process as described in Example 1 above. The scale bar is equal to about 100 μm for FIGS. 4*a* and 4*b*, and about 40 μm for FIGS. 5*a* and 5*b*. The thick web (a) that runs along the long axis of the photo is made up of two webs of pieces of greenware placed together before sintering. The plane of joining runs approximately through the center of the thick web (a–a'). After sintering, there is no microstructural evidence of discontinuity where the two pieces were joined. FIGS. 4*a* and 5*a* show the piece using Nomarski differential interference contrast to show the grain structure. FIGS. 4*b* and 5*b* show the same respective views in polarized light. The microstructure is made up of equiaxed grains bordered by grain-boundary carbides. The microstructure throughout the piece, in both single web and the joined webs, is the same. FIGS. 5*a* and 5*b* are higher magnification views of another joint in the same part that is described in FIGS. 4*a* and 4*b*. These figures were taken under the same respective conditions, except for magnification, as FIGS. 4*a* and 4*b*. In these figures, the uniformity of the microstructure can be clearly seen. There is no discontinuity where the greenware webs were placed together. A completely uniform and homogeneous microstructure has been achieved.

It should be understood that while the present invention has been described in detail with respect to certain illustrative embodiments thereof, it should not be considered limited to such but may be used in other ways without departing from the spirit of the invention and the scope of the appended claims.

What is claimed is:

1. A method of making a complex shaped body, said method comprising:

a) providing a plurality of green bodies, composed of one or more component metals, each body having an inlet end and an outlet end and having a multiplicity of cells extending from said inlet end to said outlet end;

b) forming an assembly of said green bodies; and c) bonding the green bodies by a method consisting essentially of sintering said assembly at a temperature and time sufficient to cause interdiffusion of some of said one or more component metals and form a microscopically indistinguishable bond between the resulting sintered bodies to form a complex body.

2. A method of claim 1 wherein said bodies are honeycombs.

3. A method of claim 2 wherein said honeycombs are joined such that the cells of neighboring honeycombs run in non-parallel directions with respect to one another.

4. A method of claim 2 wherein said honeycombs are joined end to end with the cells of adjoining honeycombs being rotated with respect to one another.

5. A method of claim 1 wherein said complex body is essentially fully dense.

6. A method of claim 1 wherein the component metals of the body comprise one or more iron group metals, and aluminum.

7. A method of claim 6 wherein said iron group metal is iron.

8. A method of claim 1 wherein the component metals of the body are Fe, Al and Cr.

* * * * *